US005350079A

United States Patent [19]

Larson et al.

[11] Patent Number: 5,350,079

[45] Date of Patent: Sep. 27, 1994

[54] SAFETY COVER ASSEMBLY FOR OPEN CONTAINER

[75] Inventors: Douglas A. Larson, River Forest; Thomas J. Danowski; Roy Voss, both of Elgin, all of Ill.

[73] Assignee: Safety-Kleen Corp., Elgin, Ill.

[21] Appl. No.: 24,631

[22] Filed: Mar. 1, 1993

[51] Int. Cl.[5] ..... B65D 43/26

[52] U.S. Cl. ..... 220/264; 220/908

[58] Field of Search ..... 220/263, 264, 908

[56] References Cited

U.S. PATENT DOCUMENTS 1,012,346 12/1911 Fraser ..... 220/264
1,195,481 8/1916 Legat et al. ..... 220/264
1,236,429 8/1917 Hansen ..... 220/263

*Primary Examiner*—Allan N. Shoap
*Assistant Examiner*—Nova Stucker
*Attorney, Agent, or Firm*—James T. FitzGibbon

[57] ABSTRACT

A safety cover assembly for use with an associated storage drum. The assembly includes a drum insert with a collar having a two-part cover assembly disposed atop the collar. The moveable part of the cover assembly is actuated by one portion of a crank mechanism, the other portion of which includes a pair of ends secured to a treadle and riser assembly. In use, pushing down on the treadle lowers the one portion of the crank mechanism, and raising the other portion and the associated cover. The treadle and riser assembly is open at the rear to facilitate removal and replacement of the drum. The moveable cover part may be secured to the crank by a fusible link for fire protection.

11 Claims, 2 Drawing Sheets

SAFETY COVER ASSEMBLY FOR OPEN CONTAINER

BACKGROUND OF THE INVENTION

The present invention relates generally to container accessories, and more particularly to a novel safety cover assembly for open containers. One important aspect of the invention is the provision of a cover assembly which permits easy removal of the container from the cover assembly.

As interest continues to increase in protection of the environment from the adverse effects of inappropriate waste discharge, specialized problems of disposal continue to occur. Disposition of scrap material that was not considered objectionable in the past is now considered at least potentially damaging to the environment and hence at last potentially objectionable. In addition to escalating environmental concerns, the public at large, and particularly the industrial sector, has developed an increasing consciousness of the need for work place safety. This includes safety against fire hazards and hazards of airborne pollution, such as that occasioned by fumes, vapors, or the like.

Specifically, certain industrial areas, including manufacturing facilities, machine shops, and the like are areas wherein various oils and oily materials are commonly generated and/or spilled. Although these spills are usually in amounts that would formerly have been considered very minor quantities, the potential of cumulative, careless disposition of such wastes could be considered hazardous or at least undesirable.

For example, in industrial environments including machine shops and elsewhere where cutting, drilling, boring, and like operations are conducted, there is considerable spillage of liquids, including lubricants, coolants, cutting oils, and the like. For purposes of immediate safety, it has been customary to attempt simply to absorb these materials on the spot with absorbents of various kinds. This has involved distribution of a solid, granular absorbent over the affected area, and then, after absorption has taken place, sweeping or vacuuming the oil-contaminated granular materials up and placing them in a disposition area.

Depending upon the nature of the oily material and the granular absorbent, the contaminated absorbent can pose a significant environmental risk or safety hazard. For example, if cellulosic material such as excelsior, saw dust, wood chips or the like or used, these materials are, in and of themselves, a fire hazard. When soaked or contaminated with oil, this risk is exacerbated.

More popular types of granular, oil absorbent materials include those which, although not flammable, may nevertheless contribute to fire because of their oil or like content. These include various silica materials, inorganic absorbents of various kinds and the like. As will be appreciated, once the materials have absorbed oil, they are unable to be disposed of in any location where the oil absorbed therein could be leached out into the ground water table or could otherwise contaminate the environment.

With the foregoing in mind, there have been attempts made to confine the materials in containers for safe keeping. However, the requirements for such containers are more diverse than might at first be thought. For example, the containers should allow easy access and yet be kept closed in normal use. Where the contents are to be emptied frequently, ease of access to the container should be provided.

Accordingly, the present invention is directed to an improved storage and disposition container for oil soaked or otherwise contaminated materials of this type. The invention provides a convenient, foot-activated cover actuating assembly for such a disposition container. By providing for foot operation of the cover assembly, the device of the present invention significantly reduces the likelihood of spillage by allowing the operator to use both hands to control and contain the contaminated materials while they are being transferred to or from the container.

The present invention is further directed to a foot-activated cover and opening assembly that is simple and convenient to remove from various disposition containers, so as to allow ready and convenient replacement of such containers. While various foot-activated lid or cover opening devices exist in the art, many require that the disposition container be lifted and placed into the cover opening device. In contrast, in the present invention, the cover and opening assembly are lifted only a minimal amount, after which the disposition container can be removed and replaced. This is advantageous in that, if the disposition container is full of material, and thus is rather heavy, the relatively light cover and opening assembly are much easier and convenient to lift. This is additionally advantageous in that it substantially reduces the likelihood of spillage, because the disposition container need not be lifted for removal.

Foot-activated lid openers for various containers have been widely utilized in the past. For example, in U.S. Pat. No. 4,593,873 a portable hamper with a foot operated cover is disclosed. Also, for example, in U.S. Pat. Nos. 962,874 and 1,131,774, foot-activated lid opening devices for garbage cans and the like are disclosed.

However in all of these cases, unlike in the device of the present invention, the garbage or like can is placed inside the lid opening device. Thus in order to remove the container from the lid opening device, the user would have to lift the garbage can by an amount sufficient to clear the retaining means utilized by each of these inventions to keep the garbage can in place. Obviously, if the garbage can is full this may be a very difficult task. Additionally, if the garbage can is of a large size, say 30 or 55 gallons, or contains hazardous material, the danger of spilling the materials contained within the garbage can is greatly increased while it is being lifted. In contrast, the present invention allows the cover and opening assembly to be placed on another receptacle or container without having to lift the absorbent container itself, thus significantly reducing the likelihood of spilling the contents of the absorbent container.

In U.S. Pat. Nos. 1,229,777 and 1,012,346 foot operated garbage can lid opening devices are disclosed which are integral to the garbage can itself. These inventions obviously lack the unique and useful feature of the present invention whereby the combination cover and opening assembly can be conveniently removed, and thus utilized on different containers. The present concept also permits the container to be of a standard type that can be replaced periodically on a service basis, for example.

The present invention is ideally suited for use in machine shops or the like, where as previously suggested, a waste disposal company could contract to remove and properly dispose of the user's potentially hazardous waste materials periodically. In such a case each shop can receive one of the combination lid and opening devices of this invention. When the drum that is being used to dispose of the hazardous material is nearly full, an employee of the waste disposal company can simply deliver an empty drum to replace the full one.

It is a very simple and convenient process for the employee of the waste disposal company to place the empty drum near the full drum, and remove the cover opening assembly from the full drum and place it on the empty one. The employee can then properly seal the drum with the contaminants or other waste material within the drum before attempting to remove it from the shop. Obviously, then, the process of disposing of such hazardous materials is made much more convenient and safe if a product embodying the invention is utilized.

The present invention is further directed to a foot-activated cover opening assembly that is simple and convenient to remove from the disposition container because it is only necessary to lift the device a few inches in order to remove it. In contrast, most or all existing devices require that the disposition container be lifted an amount equal to or near its entire length. Thus, the invention greatly simplifies the process of separating the disposition container from the cover opening device.

Accordingly, it is a general object of the present invention to provide a new and improved combination storage and disposition container cover for contaminated materials.

Another object of the present invention is to provide a container cover unit with a foot-actuated cover opening device that is simple and convenient to operate, and easy to associate with or remove from various storage and/or disposition containers.

A still further object of the invention is to provide a container cover unit that includes a positioning collar that is self-locating within the open top of a container and which includes a screen or the like to control the nature of the product disposed in the drum or container.

Another object of the invention is to provide a container cover unit with a foot actuated cover opening device that utilizes a lift frame that is constructed and arranged to allow ready replacement of a container for potentially hazardous materials.

A still further object of the invention is to provide a safety cover unit which may be opened by actuating a foot-operated treadle unit but which, even if intentionally opened, will close automatically in the presence of elevated temperatures such as those caused by flames, for example.

Yet another object of the invention is to provide a container cover with a pedal-actuated cover opening device that utilizes both fixed and movable cover elements secured to each other by a hinge and actuable by a crank mechanism secured at one of its ends to a movable cover panel and at the other to a vertically extending end portion of the lift frame and wherein the hinge provides the pivot axis for the opening and closing action.

A further object of the invention is to provide a container cover unit and opening device wherein the lift frame includes spacer buttons adapted to engage but slide along the outer surface of an associated drum or container to position the frame during the lid or cover-opening operation.

Yet another object of the invention is to provide an apparatus as referred to herein wherein the cover unit includes an insert in the form of a circular collar with a locating flange formed from its upper margin and wherein the lower margin of the collar supports a screen made from expanded metal material or the like.

A still further object of the invention is to provide an apparatus for transiently storing combustible or potentially combustible materials in drums or like containers and wherein the operation of the apparatus is such as to facilitate removing and replacing the containers on a service basis wherein standardization of containers is important.

The foregoing and other objects are achieved in practice by providing a safety cover assembly for use with an associated drum unit that includes a drum insert unit having a collar generally congruent with an upper margin of the associated drum, a collar flange that vertically positions the collar within the drum, a cover assembly with a fixed cover element extending chordwise across part of the opening defined by the drum insert unit, a movable cover panel extending across the remainder of the opening, a hinge connecting the fixed element to the movable cover panel, a lift frame assembly having a generally horizontally extending treadle portion and a pair of risers, and a crank mechanism connecting the risers to the movable cover panel, whereby a downward movement of the treadle causes the movable cover panel to pivot about the hinge axis and lift the cover panel to provide access to the drum interior.

The exact manner in which the foregoing and other objects and advantages of the invention, including those inherent in the invention, are achieved in practice and will be more clearly apparent when reference is made to the following detailed description of the preferred embodiments of the invention set forth by way of example and shown in the accompanying drawings, wherein like reference numbers indicates corresponding parts throughout the several figures.

DESCRIPTION OF THE PREFERRED EMBODIMENTS OF THE INVENTION

While the invention may be embodied in units of different size, and made from a range of suitable materials, and whereas the invention is advantageously practiced with a wide variety of absorbent or other materials requiring safe and secure handling, a description will be made of an embodiment wherein the container is a standard 30 gallon metal drum, the lift frame is made from tubular metal stock, the collar is made from steel and the screen is made from an expanded metal material; the preferred embodiment also includes a fusible link completing the connection between a portion of the crank mechanism and the pivotable panel portion of the cover unit.

Figure 2:
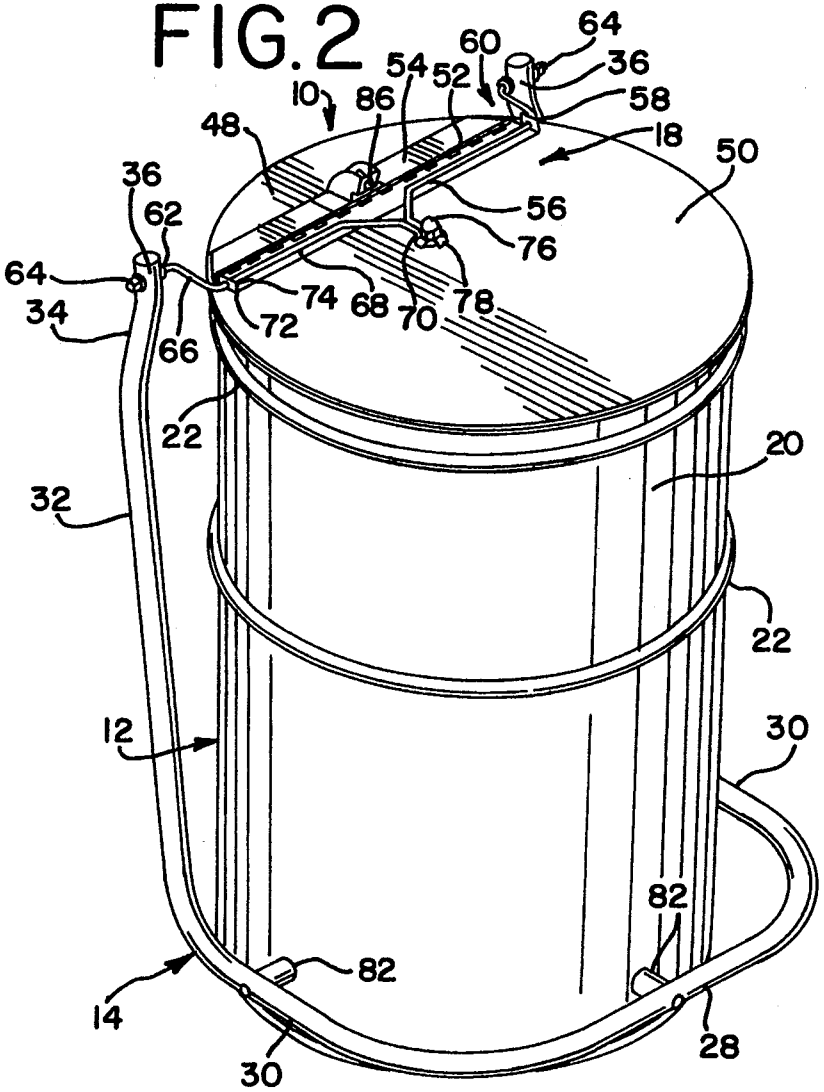
FIG. 2 is a perspective view similar to that of FIG. 1, but showing the cover of the device in a closed position.
Figure 1:
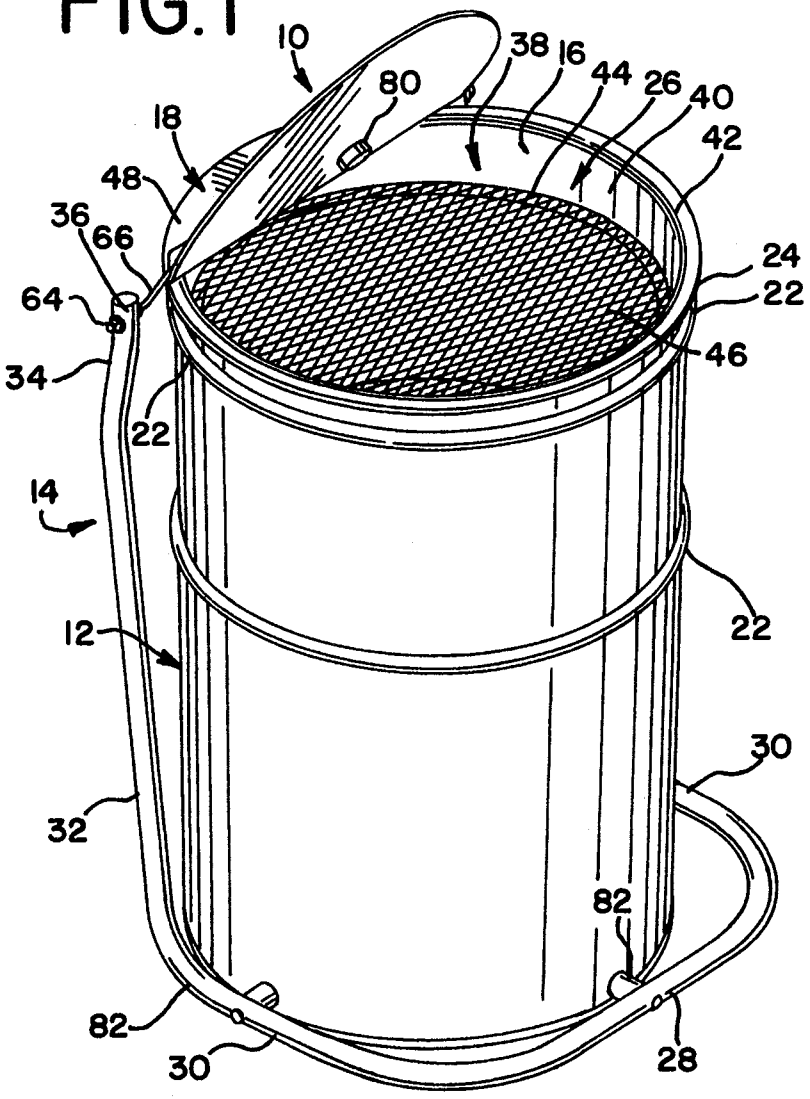
FIG. 1 is a perspective view of a standard drum or like container fitted with the combination drum insert, cover, and lift frame mechanism of the invention, and showing the cover in an open position.

Referring now to the drawings in greater detail, and particularly to FIGS. 1 and 2, a safety cover assembly generally designated 10 is shown to be associated with a removable drum or like container generally designated 12. According to the invention, the assembly 10 includes a lift frame generally designated 14, a drum insert portion generally designated 16 and a cover assembly generally designated 18.

Referring now to the drum 12, it is shown to be of conventional construction and to include a continuous outer sidewall 20 having a pair of stiffening ribs 22, and a bead 24 (See also FIG. 4) defining a top opening generally designated 26. The drum is otherwise conventional and may be supplied initially with a removable drum cover secured by a clamp (neither element being shown) to provide safety and security in handling and prior to use according to the invention.

Referring now to the lift frame assembly generally designated 14, this unit is shown to be made from a tubular material and to include a treadle 28, extending transversely across the lower front surface of the drum in use, and to further include a pair of spaced apart, parallel horizontal legs 30, and a pair of identical risers 32 (one only shown in FIGS. 1 and 2). The lift frame 14, near the upper end of the risers 32 includes an offsetting section 34; the riser 32 terminates in a straight, upwardly extending stub end 36. As will appear, the connection is made to the crank mechanism to be described later through a portion of the stub end 36.

Referring now to the drum insert unit 16, this unit is shown to include a collar generally designated 38 and shown to include a vertical wall 40, and a top flange 42 extending radially outwardly and in use resting on the top surface of the drum bead 24. In addition, the lower portion of the collar is formed in to an inturned horizontal flange 44 which serves to engage and support the outer surface of a screen 46 in circular form. As shown, the screen 46 is made from an expanded metal material, but any other screen of suitable mesh may be provided.

Figure 3:
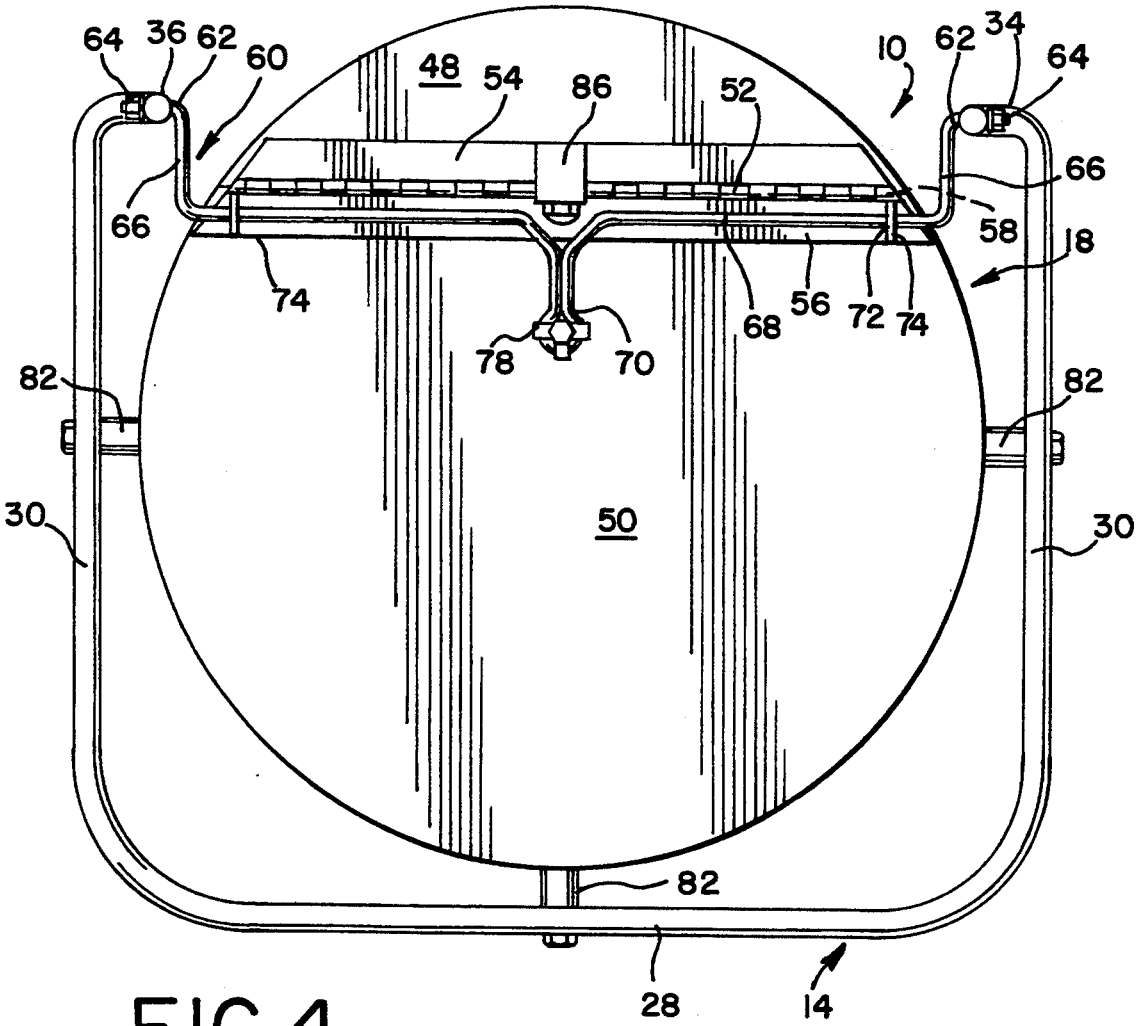
FIG. 3 is a top plan view of the container with the combination drum insert, cover and lift frame in position of use relative to the container.
Figure 4:
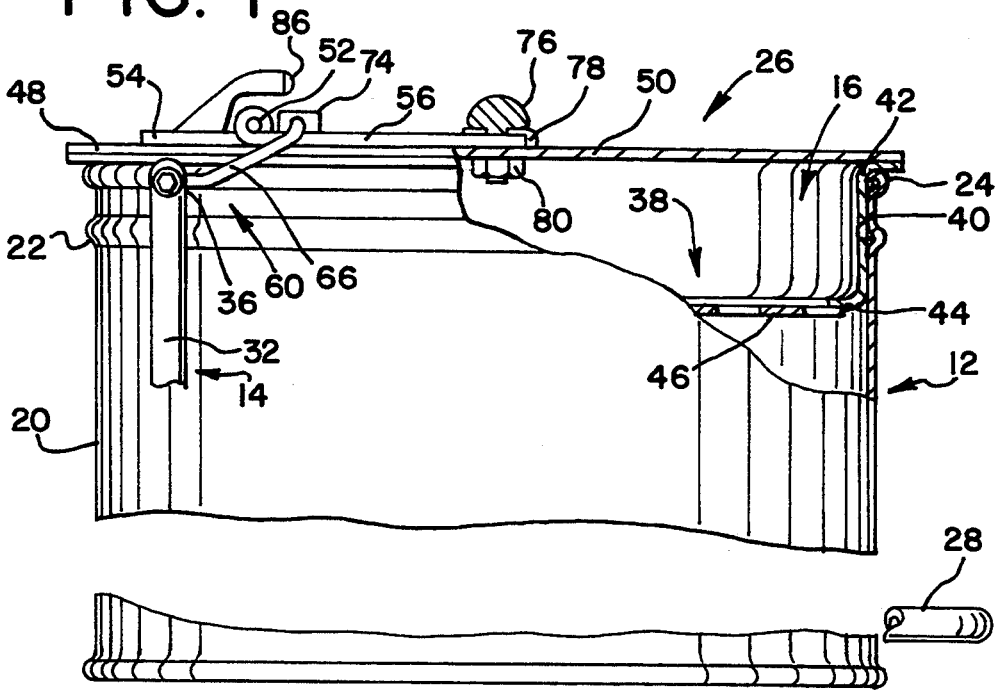
FIG. 4 is a fragmentary side elevational view, with portions broken away, showing portions of the apparatus of FIGS. 1–3.

Referring now to FIGS. 2–4, it will be noted that the cover assembly 18 provides a fixed cover element 48 extending chordwise across a portion of the opening defined by the collar 38. The lower surface of the fixed cover element 48 rests upon and is secured tightly, as by welding or crimping, to the top flange 42 of the collar 38.

FIG. 2 also shows that the cover assembly 18 includes a movable cover panel 50 which is of a generally truncated circular shape and acting as a complement to the fixed element 48 to provide a circular cover completely closing off the opening 26 in the drum 12.

The relative movement of the fixed and movable portions 48, 50 of the cover assembly 18 is provided by a hinge unit 52 shown to have a pivot axis extending chordwise across the opening; the hinge includes plates 54, 56 (FIGS. 3, 4) secured respectively to the fixed and movable panels 48, 50 of the cover, preferably by welding. In use, the hinge unit 52 permits pivotal movement of the two cover elements about the hinge axis 58.

A portion of the cover assembly 18 that is responsible for cover movement comprises a crank assembly generally designated 60 (FIGS. 3, 4) and shown to include a pair of identical, horizontally extending crank ends 62 each secured to the stub 36 by a lock nut 64 shown in FIGS. 2, 3. An offset or crank arm 66 is provided for each of the stubs, and the opposite end of the crank arm 66 includes a transverse bar portion 68 having a bight portion 70 intermediate the ends of the crank arm 66. In the form shown, the transverse bar 68 is located relative to the movable cover panel 50 by passing through openings 72 in a pair of ears 74 formed in a portion of the movable hinge plate 56.

Referring now to other elements of the cover assembly 18, it will be noted that the bight portion 70 of the crank assembly 60 is positioned by a headed fastener 76 having tabs 78 extending radially outwardly therefrom to engage the portions of the transverse bar 68 defining the bight 70.

As is shown in FIGS. 1 and 4, a fusible element 80 lies on the other end of the fastener 76 and prevents the lid from falling downwardly thereof in normal use. The fusible element 80 is provided as a safety feature, such that if a fire occurs while the lid is open, the lid will no longer be held up by the crank mechanism, and will fall to a closed position. If a fire, such as of spontaneous origin or otherwise has already started, or high temperatures are created within the interior of the drum 12, then operating the treadle will not serve to lift the cover and expose the operator to danger.

Referring now to another feature of the invention, since, in use, the treadle 28 moves up and down as the cover is opened and closed, three guide or locating buttons 82 (two only shown in FIGS. 1 and 2), made from a nylon or like stiff but lubricous material, are positioned relative to the treadle portion 28 and horizontal leg portions 30 of the lift frame 14 so as to engage the sidewall 20 of the container 12. Naturally, the inner ends of the buttons 82 are positioned so that the nylon or like surface is free to engage and slide upon the outer surface of the container 12 without damage thereto.

In the form shown in the drawings, the drum insert has been shown as cylindrical and of comparatively shallow depth. However, any shape congruent with the container and dimensioned so as to engage or be slightly spaced apart from the inner sidewalls thereof may be appropriate. Thus the screen need not cover the entire drum opening, nor need the collar itself be completely circular. Of course, the combination of the flange and the collar should cover the entire opening portion of the container for obvious reasons.

An important feature of the invention is that the transverse space between the risers 32 should be at least equal to the drum width to permit the drum to be removed from the open side of the lift frame.

In this connection, when it is desired to perform a service call, the drum insert is grasped by the overhanging edge of the cover and/or collar flange 42 and raised a distance just greater than the vertical depth of the collar 38. Thereupon, the drum is simply slid to the rear or the side opposite the treadle side of the lift frame 14. A replacement container is slid in, and the new containers positioned by accomplishing the above steps in reverse order.

The screen is an optional feature but is preferred inasmuch as the absorbent material, in use, may become caked, and it may be desired to subdivide it into smaller particle size for insertion into the drum, particularly bearing in mind that spontaneous combustion hazards are greatest wherein potentially combustible material is closely surrounded by thermally insulating materials.

Referring to the action of the lift frame, in normal use, with the cover closed, the weight of the removable cover panel 50 is more than sufficient to maintain the lift frame in a slightly elevated position, preferably 3 to 6 inches above the floor level. When the treadle is pushed downwardly with the foot, the crank arm 66 rotates about the hinge access 58, lifting the movable cover panel 50. When the treadle downforce is released, the cover will return to a closed position, as long as the weight of the cover panel and its distance from that hinge axis create a force that is greater than that imparted by the weight of the lift frame. The self-closing feature of the apparatus 10 is important from the fire safety standpoint, in that an unattended drum will always be maintained in the closed position.

In this connection, reference is made again to FIG. 2, wherein it is shown that a snubber 86 is provided for engaging a portion of the movable cover panel 50. This prevents the cover panel from achieving an over-center or raised position sufficient to permit it to remain open and unattended. The snubber limits the angular relation of the cover elements 48, 50 for safety reasons.

A typical crank mechanism has been illustrated, but any suitable arrangement that provides a force-applying attachment on the side of the hinge axis opposite the side on which the covered panel 50 is disposed will ensure that a downward force on the lift frame will cause the cover to be raised.

According to the invention, the service operator, for example, may typically provide one full drum of material, such as an oil absorbent, and another empty drum with the novel cover unit associated with it. The full drum serves as the supply of absorbent which is gradually depleted and finds its way into the container protected by the safety cover unit. When a service call is made, the drum full of soiled absorbent is removed, the empty drum formerly furnished with new absorbent is then associated with the cover unit, and a new supply of absorbent is provided in a fresh container. This cycle is periodically repeated as demand for the absorbent is satisfied.

It will thus be seen that the present invention provides an improved apparatus for safely covering a removable drum and permitting access thereto when needed. A representative example of the container cover of the invention having been illustrated by way of example, it is anticipated that variations and modifications of the described form of apparatus will occur to those skilled in the art and it is anticipated that such variations and changes may be made without departing from the spirit of the invention or the scope of the appended claims.

We claim:

1. A safety cover assembly for use with an associated drum unit comprising, in combination, a drum insert portion having a collar element defining an opening for receiving materials to be stored and disposed of, said collar element being generally congruent and dimensioned to fit within an upper margin of said associated drum, said collar having a top flange portion which extends radially outwardly to position said collar in relation to said drum; a cover assembly having a fixed cover element extending chordwise across a portion of said opening, a movable cover panel extending substantially across the remainder of said opening, and a hinge pivotally connecting said fixed cover element to said movable cover panel along a hinge axis; a lift frame assembly having a generally horizontally extending treadle portion, a pair of risers extending upwardly toward said cover assembly, and a crank mechanism having a pair of elements engaging the upper ends of said risers and another element secured to said movable panel, whereby a downward movement of said treadle portion will cause said movable cover panel to pivot about said hinge axis and raise said movable cover panel so as to provide access to the interior of said drum.

2. A safety cover assembly as defined in claim 1 which further includes a screen extending across said opening to permit only particles no larger than a given size to enter said drum.

3. A safety cover assembly as defined in claim 2 wherein said collar further includes an inwardly directed radial flange forming its lowermost portion and wherein said screen is secured to said flange.

4. A safety cover assembly as defined in claim 1 wherein said lift frame further includes a pair of horizontally extending members affixed at one of their ends to said horizontally extending treadle portion and at their other ends to said risers.

5. A safety cover assembly as defined in claim 1 wherein said lift frame further includes at least one antifriction locating button, said button being attached to an inner side of said treadle portion so as to slidingly engage the outer surface of said drum.

6. A safety cover assembly as defined in claim 4 wherein said lift frame further includes at least three antifriction locating buttons for sliding engagement with the outer surface of said drum, one of said buttons being secured to said treadle and the others being secured to inner surfaces of said horizontal legs.

7. A safety cover assembly as defined in claim 1 which further includes a snubber element attached to said fixed cover element, said snubber being positioned so as to engage an upper surface of said movable cover panel when said panel has pivoted through a predetermined angle.

8. A safety cover assembly as defined in claim 1 wherein said top flange portion is integral with said collar for engaging the upper rim of said drum.

9. A safety cover assembly as defined in claim 1 wherein said movable cover panel is gravity-biased to a normally closed position.

10. A safety cover assembly as defined in claim 1 which further includes a fusible element forming a part of the connection between said movable cover panel and said another element of said crank mechanism, whereby said cover will close off said opening if the drum contents become overheated.

11. A safety cover assembly as defined in claim 1 wherein said radially outwardly extending flange portion is dimensioned so as to rest upon the rim of said drum.

* * * * *